US006305369B1

(12) United States Patent
Garloch

(10) Patent No.: US 6,305,369 B1
(45) Date of Patent: Oct. 23, 2001

(54) SAFEGUARD FOR FURNACE DRAFT SYSTEM

(75) Inventor: Duane David Garloch, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/691,418

(22) Filed: Oct. 18, 2000

(51) Int. Cl.[7] ..... F24H 3/00; F23N 5/02

(52) U.S. Cl. ..... 126/116 A; 126/116 R; 431/18; 431/21

(58) Field of Search ..... 126/99 R, 110 A, 126/110 R, 112, 116 A, 116 R, 307 R, 312; 431/13, 14, 15, 16, 21, 18; 374/141, 147, 148, 208; 34/575, 606, 607, 608

(56) References Cited

U.S. PATENT DOCUMENTS

| | | | | |
|---|---|---|---|---|
| Re. 30,936 | * | 5/1982 | Kmetz et al. | 431/22 |
| 2,913,044 | * | 11/1959 | Mobley | 158/122 |
| 3,537,803 | * | 11/1970 | Ignazio | 431/22 |
| 3,542,018 | * | 11/1970 | Quick | 126/116 |
| 4,189,296 | * | 2/1980 | Hayes | 431/20 |
| 4,289,271 | * | 9/1981 | Barth . | |
| 4,340,355 | * | 7/1982 | Nelson et al. | 431/20 |
| 4,401,425 | * | 8/1983 | Gable et al. | 431/22 |
| 4,603,680 | * | 8/1986 | Dempsey et al. | 126/99 A |
| 4,613,297 | * | 9/1986 | Zanias et al. | 431/16 |
| 4,708,636 | * | 11/1987 | Johnson | 431/20 |
| 4,899,726 | * | 2/1990 | Waterman | 126/110 R |
| 4,951,651 | * | 8/1990 | Shellenberger | 126/116 R |
| 4,974,579 | * | 12/1990 | Shellenberger et al. | 126/110 |
| 5,368,010 | * | 11/1994 | Weber et al. | 126/110 R |
| 5,575,274 | * | 11/1996 | DePalma | 126/512 |
| 5,799,646 | * | 9/1998 | Zia et al. | 126/110 R |

* cited by examiner

*Primary Examiner*—Henry Bennett
*Assistant Examiner*—K. B. Rinshart
(74) *Attorney, Agent, or Firm*—Wall Marjama & Bilinski

(57) ABSTRACT

A draft safeguard apparatus for use in a multi-poised furnace having an inducer housing for receiving flue gases from a heat exchanger. The furnace flue pipe is attached to the inducer housing by an elbow having a first linear inlet section that is rotatably connected to the inducer housing and a second linear outlet section that is connected to the flue pipe. A bend section connects the inlet and outlet section of the elbow. An elongated sensor housing is mounted upon the inlet section of the elbow. The housing provides a flow channel so that the inlet section of the elbow communicates with the surrounding ambient. A limit switch is mounted in the housing to sense the temperature in the flow passing through the housing. When the furnace is operating normally, ambient air is drawn into the vent system through the sensor housing. If the vent system becomes restricted, the flow through the housing is reversed and the limit switch is opened when the reverse flow temperature exceeds a given limit.

10 Claims, 3 Drawing Sheets

SAFEGUARD FOR FURNACE DRAFT SYSTEM

FIELD OF THE INVENTION

This invention relates generally to apparatus for mounting a draft safeguard switch in a multi-poise furnace.

BACKGROUND OF THE INVENTION

As disclosed in the Gable et al. U.S. Pat. 4,401,425, control devices for shutting down gas fired furnaces in the event the flue gas venting system becomes clogged are known in the art. In the Gable et al. patent, flue gases from a collector box are moved by a fan or blower into a second discharge box and then exhausted into a vent pipe. A baffle is used to direct the flue gases from the blower to the vent pipe to produce a negative pressure within the discharge box to produce a natural draft in the flue system.

A draft safeguard switch (DSS) is attached to the side of the discharge box and includes a chimney-like connector through which ambient air is drawn into the discharge box during normal operations. If a pressure above ambient pressure builds up in the discharge box, because of a fault in the venting system, flue gases are forced out of the discharge box through the connector, thereby raising the temperature in the connector. A temperature sensitive switch is attached to the connector which opens when a threshold temperature is sensed which, in turn, shuts down the furnace and the fuel supply valve.

Although the DSS system described in the Gable et al. patent works well in practice, it does not lend itself readily to use in multi-poise furnaces where the furnace can be oriented in a number of different positions that require the flue pipe to be correspondingly reoriented. As noted, the system disclosed by Gable et al. includes a fixed baffle which is needed to create a negative pressure within the discharge box so that the flue gases can flow naturally into the vent system. Although many of the prior art systems operate well in practice, the overall sensitivity of the devices in detecting a restriction in the vent system of a gas fired furnace is generally lower than desired.

SUMMARY OF THE INVENTION

It is therefore an object of the present invention to improve apparatus for shutting down a furnace in the event the furnace vent becomes blocked.

It is a further object of the present invention to provide a draft safeguard system that can operate effectively in multi-poised furnaces regardless of the furnace orientation.

A still further object of the present invention is to increase the sensitivity of a draft safeguard system used in a gas fired furnace.

These and other objects of the present invention are attained by draft safeguard systems for use in a multi-poise furnace having an inducer box located at the outlet of the furnace heat exchanger. A vent pipe is attached to the inducer housing by an elbow having a linear inlet section that is rotatably connected to the inducer box and a linear outlet section connected to the vent pipe. The two linear sections of the elbow are, in turn, connected by means of a bend section. The elbow can be rotated within the collector box to different positions, depending upon the furnace's orientation. An elongated flue gas sensor housing is mounted upon the outlet section of the elbow and contains a first opening that communicates with the flue gas flow within the elbow and a second opening that communicates with the surrounding ambient. A temperature sensing limit switch is mounted upon the sensor housing adjacent to the second opening for sensing the temperature of the flow moving through the sensor housing between the openings. Under normal furnace operations, ambient air is drawn into the inducer box through the sensor housing. In the event of a vent blockage, the flow is reversed and hot flue gases pass over the limit switch cycling the switch and shutting down the furnace.

BRIEF DESCRIPTION OF THE DRAWING

For a better understanding of these and other objects of the present invention, reference will be made to the following detailed description of the invention which is to be read in connection with the accompanying drawing, wherein.

DETAILED DESCRIPTION OF THE INVENTION

Figure 1:
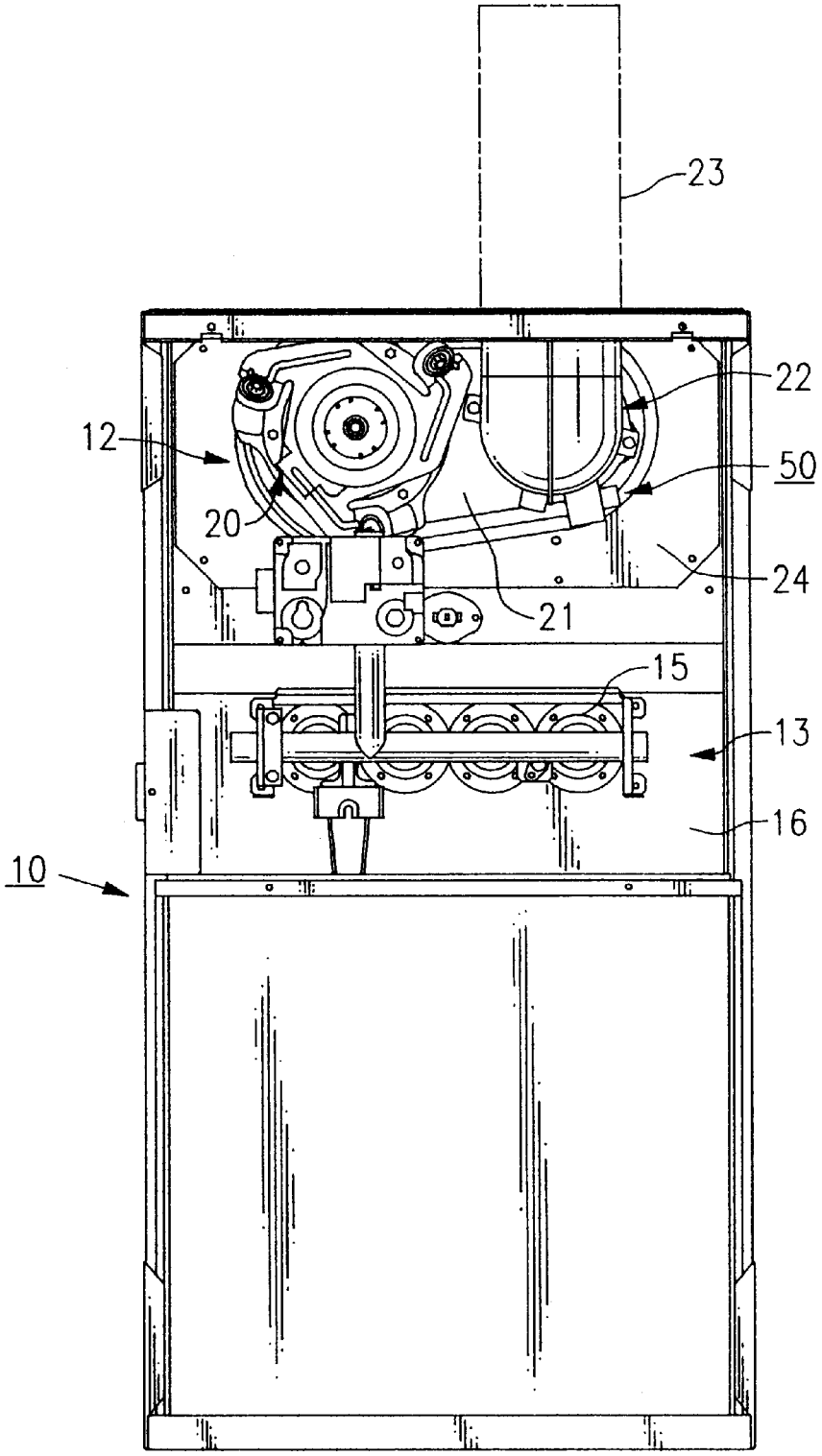
FIG. 1 is a front view of a multi-poise furnace illustrated in an upright position with the upper front covers removed to show the inducer and burner sections of the furnace.

Turning initially to FIG. 1, there is illustrated a gas fired multi-poise furnace, generally referenced 10, that contains an inducer assembly 12. The furnace is shown in an upright position wherein the return air from the comfort region enters the lower part of the furnace and passes vertically in an upward direction through a bank of heat exchangers in the upper part of the furnace prior to being returned to the comfort region. The burner assembly 13, seen in the front opening 16 of the furnace, contains four burners 15, although the furnace may contain more or less burners. Mounted directly over the burner assembly is the inducer assembly. The inducer fan motor unit 20 is secured to the front wall of the inducer housing 21, along with a vent elbow 22 that connects the inducer housing with a flue pipe 23.

Figure 2:
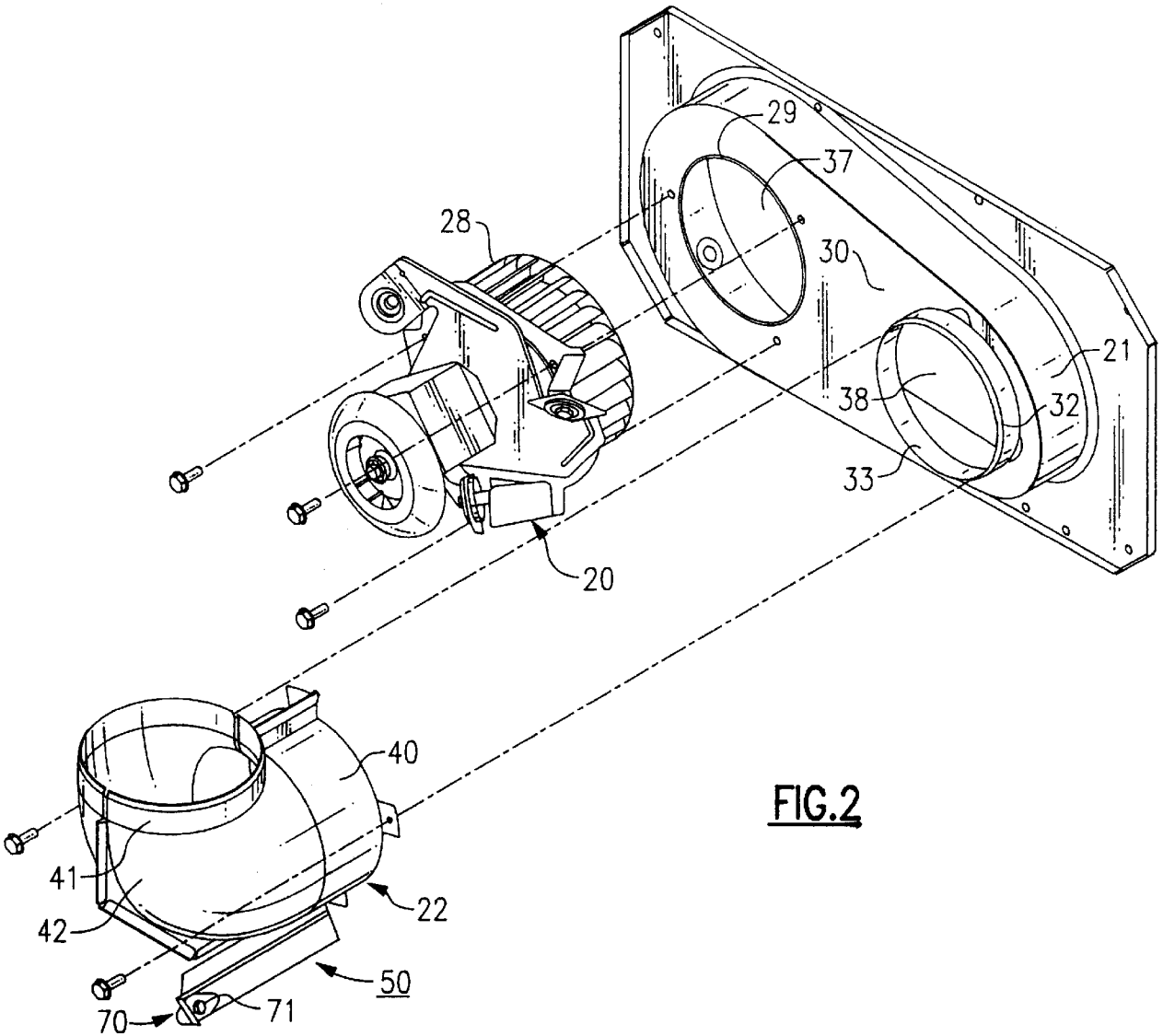
FIG. 2 is an exploded view in perspective showing the inducer box assembly of the present furnace.

The inducer assembly is shown in greater detail in FIG. 2. The unit includes the previously noted inducer housing 21 that is secured in assembly to a back wall 24 that closes against the heat exchanger discharge duct. The back wall of the inducer housing contains a generous opening (not shown) that communicates with the heat exchanger outlet. The fan motor unit includes a blower 28 which, in assembly, passes through an opening 29 formed in the front wall 30 of the inducer housing. The fan motor assembly 20 is secured to the front wall of the inducer housing over the blower opening to position the blower adjacent to and in axial alignment with the opening to the furnace heat exchange that is contained in the rear wall of the inducer housing.

The vent elbow 22 is arranged to pass over a cylindrical discharge flange 32 that surrounds a flue gas discharge opening 33 formed in the front wall of the inducer housing adjacent to the blower opening. The inducer housing is divided by a scroll into two separate chambers that are the blower chamber 37 and the discharge chamber 38. In operation, the blower fan creates a draft in the heat exchanger outlets, thereby inducing the flue gases to flow into the discharge chamber in the inducer housing and then out of the furnace via the flue pipe.

Figure 3:
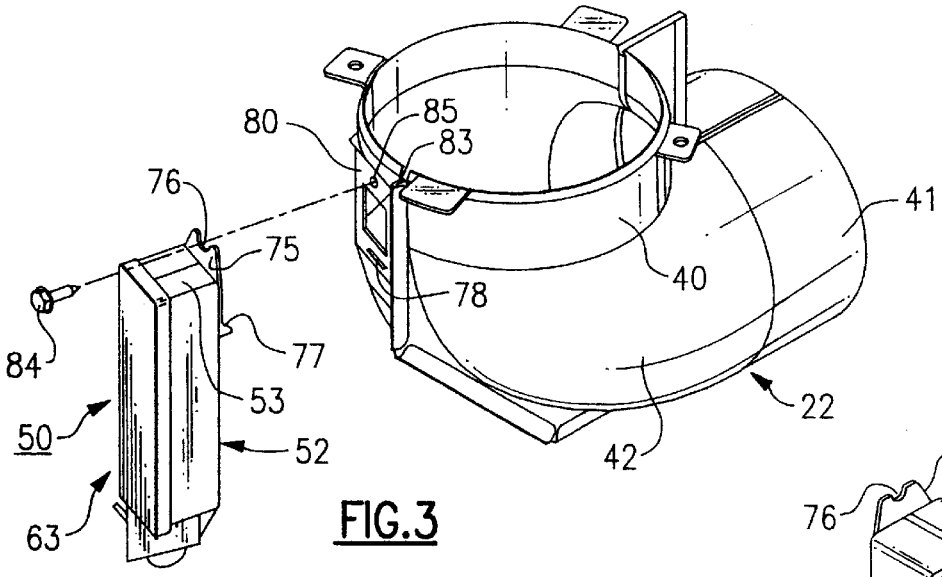
FIG. 3 is a further enlarged view in perspective showing the elbow of the vent system for connecting the inducer box to a furnace flue pipe and further illustrating the sensor housing attached to the elbow.
Figure 5:
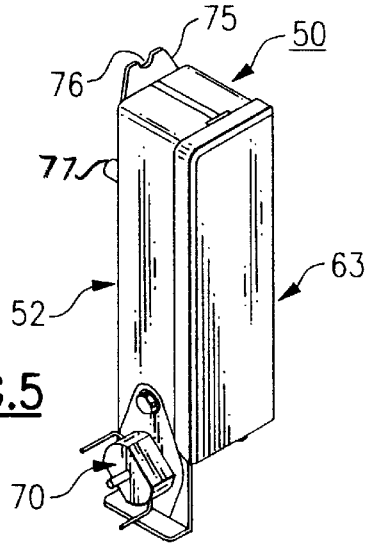
FIG. 5 is an assembly drawing, in perspective, of the flue gas sensor housing.
Figure 4:
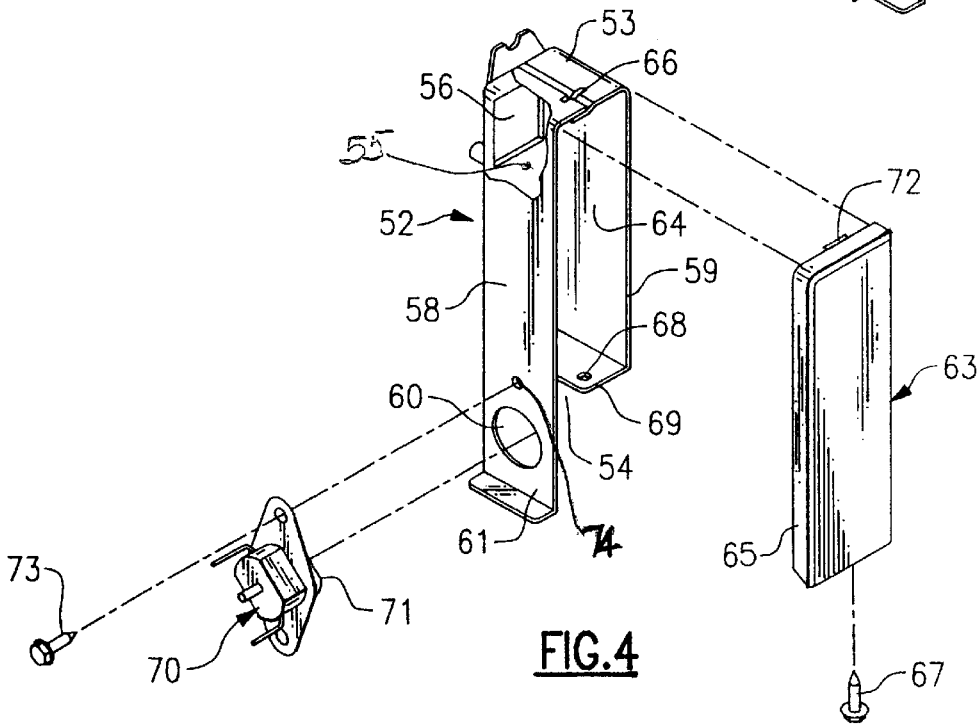
FIG. 4 is an exploded view in perspective showing the component parts of the flue gas sensor housing.

With further reference to FIGS. 3 through 5, there is shown in greater detail the apparatus of the present invention. The vent pipe elbow, generally referenced 22 includes a straight or linear inlet section 40 that is connected to the discharge flange 32 of the inducer housing so that the elbow can be rotated to various positions relating to the furnace orientation. The inlet section 40 is connected to a linear outlet section 41 by means of a bend section 42. The outlet section of the elbow, in turn, is joined to the flue pipe 23 using any well known joining techniques thereby attaching the inducer housing to the flue pipe. As illustrated, the bend section of the elbow turns through 90° of arc, however, it should be clear to one skilled in the art, that the bend of the elbow can be greater or less than 90° without departing from the teachings of the invention.

An elongated flue gas sensor housing, generally referenced 50, is secured to the inlet section of the elbow so that the housing will rotate with the elbow as the elbow is moved to different positions relating to the furnace's orientation. The sensor housing includes a three-sided body 52 that is closed at one end by an end wall 53 and is open at the opposite end 54. A first side wall 55 of the three side walls contains a rectangular shaped opening 56 at its upper end adjacent to the end wall 53. A second side wall 58 is longer than the opposing third side wall 59 of the body and contains a circular hole 60 in the extended section 61 (FIG. 4) thereof. The open side of the body is closed in assembly by a lid 63 so that the housing forms an elongated flow chamber 64 extending between the upper opening 56 and the bottom opening 54. The removable lid provides easy access to the housing during periodic servicing of the furnace. The lid contains a skirt 65 that extends about its entire periphery. The lid is provided with a tab 72 that is slidably received in a slot 66 formed in the end wall 53. A screw 67 is passed through the opposite end of the skirt as illustrated in FIG. 4 and is threaded into a hole 68 provided in a lip 69 that depends inwardly from the body side wall 59.

A normally closed temperature limit switch 70 is mounted in the extended section 61 of side wall 58. The switch contains a probe 71 (FIG. 1) that is adapted in assembly to pass through the hole 60 contained in the extended section of side wall 58. The limit switch is secured to the extended section by a screw 73 that is threaded into a hole 74 provided in the extended section of side wall 58 so that the probe will be exposed to a flow of gas or air passing into or out of the housing through the adjacent open end 54 of the housing. As will be explained below, the limit is adapted to sense the temperature in the flow stream and cycle open in the event the temperature exceeds a given value thereby shutting down the furnace.

The side wall 55 of the body section 52 protrudes outwardly beyond the end wall 53 to form a rib 75. The protruding rib 75 of the wall contains a semi-circular slot 76 formed therein. As best seen in FIG. 3, an outwardly extended tab 77 is mounted immediately beneath the opening 56 in side wall 55 and is arranged to be hooked through hole 78 in the flat rectangular shaped mounting pad 80 contained on the inlet section 40 of the vent elbow 22. The mounting pad surrounds a clear rectangular shaped opening or window 83 that passes through the inlet section, in assembly, with the tab inserted in the hole 78, and the sensor housing is secured to the pad using a screw 84 that is passed through the semi-circular slot 76 of rib 75 and is threaded into hole 85 provided in the mounting pad. When the housing is secured to the elbow, the upper opening 56 in the housing is aligned with the window 83 in the elbow. Accordingly, gas or air can flow in either direction between the two openings in the housing between the surrounding ambient and the inducer housing.

Due to the flue gas temperature and the flue gas velocity in the inducer housing, the linear inlet section 40 of the vent elbow 22 is placed under a negative pressure when the furnace is operating normally. In the event the vent system becomes restricted, the pressure in the elbow will increase. The elbow thus provides an ideal place to mount the safeguard limit switch 70 and thus eliminate the need of a baffle plate or the like in the inducer to create the necessary pressure differences to establish a natural flow through the vent system.

As noted above, the sensor housing is connected directly to the elbow and gas can be exchanged between the housing and the elbow through the coaligned opening 56 and window 83. During normal furnace operations, ambient air is drawn into the sampling tube due to the negative pressure that is seen by the inlet section of the elbow and is passed into the vent system. The air flow is relatively low and thus will not adversely effect the furnace operation. The temperature sensed by the safeguard switch 70, in turn, at this time, is relatively low and the switch, which is normally closed, will remain closed to maintain the furnace in operation. In the event the vent system becomes restricted, the pressure at the inlet to the elbow increases and the flow through the sensor housing is reversed whereupon hot flue gases from the vent system flow outwardly through the housing to the surrounding ambient. The hot flue gases leaving the housing pass over the sensor probe and the switch is opened when a given threshold temperature is exceeded thereby shutting down the furnace.

As can be seen, positioning the sensor housing as shown on the elbow keeps the safeguard switch some distance away from the inducer housing in a relatively cool region during normal furnace operation. Because the sensor housing is adapted to rotate with the vent elbow for various furnace orientations, the sensor will provide a uniform output regardless of the furnace orientation.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. Draft safeguard apparatus for use in a multi-poise furnace having an inducer housing for receiving a flow of flue gas from the furnace heat exchanger, said apparatus including:

an inducer fan assembly mounted upon said inducer housing and being arranged to draw flue gases from said heat exchanger into said inducer housing, an elbow mounted upon said housing apart from said inducer fan assembly, said elbow having a first linear inlet section that passes into said housing and a linear outlet section that is connected to a flue pipe, an elongated gas sensor housing mounted upon the inlet section of said elbow, said sensor housing having a first opening at one end thereof for placing the sensor housing in fluid flow communication with the inlet section of said elbow and a second opening at the other end thereof that communicates with the surrounding ambient whereby air and gas can flow between the openings, and a limit switch mounted adjacent to said second opening for sensing the temperature in the flow moving through said sensor housing, said limit switch being cycled when the flow temperature exceeds a given limit.

2. The apparatus of claim 1 wherein said limit switch is arranged to deactivate the furnace when cycled.

3. The apparatus of claim 1 wherein said inlet and outlet section of the elbow are connected by a bend section.

4. The apparatus of claim 1 wherein one side wall of the sensor housing contains an extended section that protrudes outwardly beyond the second opening in said sensor housing and said limit switch is mounted upon said extended section adjacent to said second opening whereby the sensor can detect the temperature in the flow passing through the sensor housing.

5. The apparatus of claim 1 wherein said inlet section has a mounting pad upon which the sensor housing is seated in assembly.

6. The apparatus of claim 5 wherein said mounting pad contains a window that is placed in alignment with said first opening in said housing when said sensor housing is attached to said elbow.

7. The apparatus of claim 6 wherein said inlet section of said elbow is rotatably coupled to the inducer housing.

8. The apparatus of claim 3 wherein said bend section of said elbow turn through an arc of 90°.

9. The apparatus of claim 1 wherein said limit switch is a normally closed switch and is adapted to open when said given temperature limit is reached or exceeded.

10. The apparatus of claim 1 wherein said sensor housing includes a removable lid for providing access to said sensor housing.

* * * * *